US012209587B2

(12) United States Patent
Lalchandani et al.

(10) Patent No.: US 12,209,587 B2
(45) Date of Patent: Jan. 28, 2025

(54) ELEMENT, DEVICE AND METHOD FOR COMPRESSING GAS TO BE COMPRESSED HAVING A LOW TEMPERATURE

(71) Applicant: ATLAS COPCO AIRPOWER, NAAMLOZE VENNOOTSCHAP, Wilrijk (BE)

(72) Inventors: Mukesh Lalchandani, Wilrijk (BE); Simon De Bock, Wilrijk (BE); Tom Van Troos, Wilrijk (BE)

(73) Assignee: ATLAS COPCO AIRPOWER, NAAMLOZE VENNOOTSCHAP, Wilrijk (BE)

( * ) Notice: Subject to any disclaimer, the term of this patent is extended or adjusted under 35 U.S.C. 154(b) by 0 days.

(21) Appl. No.: 18/286,293

(22) PCT Filed: Mar. 24, 2022

(86) PCT No.: PCT/EP2022/057738
§ 371 (c)(1),
(2) Date: Oct. 10, 2023

(87) PCT Pub. No.: WO2022/214322
PCT Pub. Date: Oct. 13, 2022

(65) Prior Publication Data

US 2024/0191714 A1 Jun. 13, 2024

(30) Foreign Application Priority Data

Apr. 9, 2021 (BE) ..... 2021/5278

(51) Int. Cl.
*F04C 29/04* (2006.01)
*F04C 2/16* (2006.01)
(Continued)

(52) U.S. Cl.
CPC ..... *F04C 29/04* (2013.01); *F04C 18/16* (2013.01); *F04C 25/00* (2013.01); *F04C 29/042* (2013.01);
(Continued)

(58) Field of Classification Search
CPC ..... F04C 29/04; F04C 18/16; F04C 25/00; F04C 29/042; F04C 2/16; F04C 2210/206;
(Continued)

(56) References Cited

U.S. PATENT DOCUMENTS 8,435,020 B2 * 5/2013 Amano ..... F01C 19/005 418/98
2011/0076174 A1 * 3/2011 Kakiuchi ..... F04C 18/16 418/99
(Continued)

FOREIGN PATENT DOCUMENTS

EP 1 705 379 A1 9/2006
EP 3 587 817 A1 1/2020
(Continued)

OTHER PUBLICATIONS

International Search Report for PCT/EP2022/057738 dated Jun. 14, 2022.
Written Opinion for PCT/EP2022/057738 dated Jun. 14, 2022.

*Primary Examiner* — Essama Omgba
*Assistant Examiner* — Paul W Thiede
(74) *Attorney, Agent, or Firm* — Sughrue Mion, PLLC

(57) ABSTRACT

An element for compressing a gas to be compressed at a low temperature of −40° C. or lower, which element (1) is provided with a housing (2) containing at least one rotor (3) that is rotatably arranged with respect to the housing (2) and having an inlet (6) for the gas to be compressed and an outlet (7) for compressed gas, characterized in that the element (1)
(Continued)

is configured for compressing the gas to be compressed having the low temperature by providing the element (1) with a heating duct (8) that runs through the housing (2), the heating duct (8) being provided with an inlet (9) where a first heat medium is introduced into the housing (2) at a higher temperature than the aforementioned low temperature and an outlet (10) where the first heat medium is evacuated from the housing (2).

20 Claims, 3 Drawing Sheets

(51) Int. Cl.
*F04C 18/16* (2006.01)
*F04C 25/00* (2006.01)
*F25B 1/047* (2006.01)

(52) U.S. Cl.
CPC ..... *F04C 2/16* (2013.01); *F04C 2210/206* (2013.01); *F04C 2210/26* (2013.01); *F04C 2220/22* (2013.01); *F04C 2240/20* (2013.01); *F04C 2240/30* (2013.01); *F04C 2240/50* (2013.01); *F25B 1/047* (2013.01)

(58) Field of Classification Search
CPC ..... F04C 2210/26; F04C 2220/22; F04C 2240/20; F04C 2240/30; F04C 2240/50; F04C 15/0096; F04C 15/06; F04C 29/12; F25B 1/047
See application file for complete search history.

(56) References Cited

U.S. PATENT DOCUMENTS

| | | | | |
|---|---|---|---|---|
| 2012/0237382 | A1* | 9/2012 | Yoshimura | F04C 29/021 418/98 |
| 2019/0093659 | A1* | 3/2019 | Crum | F16N 7/34 |
| 2019/0390671 | A1* | 12/2019 | Takaki | F04C 18/16 |
| 2021/0095682 | A1* | 4/2021 | Jeung | F04D 29/057 |

FOREIGN PATENT DOCUMENTS

| | | | |
|---|---|---|---|
| JP | 4-91387 | A | 3/1994 |
| JP | 6-159280 | A | 6/1994 |
| WO | 2016/164988 | A2 | 10/2016 |

* cited by examiner

ELEMENT, DEVICE AND METHOD FOR COMPRESSING GAS TO BE COMPRESSED HAVING A LOW TEMPERATURE

CROSS-REFERENCE TO RELATED APPLICATIONS

This Application is a National Stage of International Application No. PCT/EP2022/057738 filed Mar. 24, 2022, claiming priority based on Belgian Patent Application No. BE2021/5278 filed Apr. 9, 2021.

BACKGROUND

1. Field

The present invention relates to an element, a device and a method for compressing a gas to be compressed having a low temperature.

2. Brief Description of Background Art

In the following, "low temperature" means a temperature of −40° C. or lower. The invention is thus intended for cryogenic applications.

One possible example is the compression of boil-off gases of liquid natural gas (LNG), but the invention is not limited to this.

It is known that a reciprocating compressor or piston compressor is used for such applications.

A disadvantage of such reciprocating or piston compressors is that their operation generates pulsations in a supply of compressed gas. In other words, the supply of compressed gas is not uninterrupted.

In some applications, however, an uninterrupted supply of compressed gas is necessary.

It is known that, for example, a screw compressor element having screw rotors operates continuously without the occurrence of pulsations in the supply of compressed gas. In addition, the energy consumption of a screw compressor element is lower as well.

However, a screw compressor element is unfit to be used for compressing gases having a temperature of −40° C. or lower.

A screw compressor element comprises a housing made of cast iron and screw rotors made of forged steel.

Thermal deformation of these materials, which occurs at such low temperatures, varies. This affects tolerances and clearances in the screw compressor element, which become greater due to such variation in thermal deformation, as a result of which the efficiency and performance of the screw compressor element are reduced.

For this reason, the gas to be compressed having a temperature of −40° C. or lower is first heated before going into the screw compressor element.

Although this solves the problem of thermal deformation, this is accompanied by a great deal of energy loss because the compressed gas must be cooled again after compression.

SUMMARY

The object of the present invention is to provide a solution to at least one of the aforementioned and/or other disadvantages by providing an element that can compress gas to be compressed having a temperature of −40° C. or lower.

The present invention relates to an element for compressing a gas to be compressed having a low temperature of −40° C. or lower, which element is provided with a housing containing at least one rotor that is rotatably arranged with respect to the housing and having an inlet for the gas to be compressed and an outlet for compressed gas, with the characteristic that the element is configured for compressing the gas to be compressed having the low temperature by providing the element with a heating duct that runs through the housing, the heating duct being provided with an inlet where a first heat medium is introduced into the housing at a higher temperature than the aforementioned low temperature and an outlet where the first heat medium is evacuated from the housing.

An advantage is that, by providing a first heat medium in a heating duct, heat can be supplied to the housing, which can prevent a too strong temperature drop of the housing and/or of the rotor caused by the low temperature of the gas to be compressed.

As a result of this, thermal deformation of the housing and/or rotor can be limited so that tolerances and clearances between the rotor and the housing remain within reasonable limits and thermal stresses are limited.

The inlet of the heating duct is preferably positioned in such a way that heat is exchanged between the inlet of the housing and the inlet of the heating duct.

Alternatively or in addition to this, the outlet of the heating duct is positioned in such a way that heat is exchanged between the outlet of the housing and the outlet of the heating duct.

As the temperature of the gas will increase during compression, the inlet temperature is lower than the outlet temperature. By allowing the first heat medium to first pass the inlet, the coldest location of the element, and only lastly pass the outlet, the warmest location of the element, it is possible to ensure that thermal energy in the first heat medium is distributed proportionally or evenly as heat throughout the entire housing such that a temperature gradient from an inlet side to an outlet side in the element can be limited.

In a practical embodiment of the element according to the invention, the heating duct is provided with branches that are positioned in such a way that heat is exchanged between these branches and the inlet.

Alternatively or in addition to this, the heating duct has, in a practical embodiment of the element according to the invention, a number of bends and/or curves that are positioned in such a way that heat is exchanged between said bends and/or curves on the one hand and the inlet on the other hand.

The result of this is that the first heat medium will be in close contact with the inlet over a longer period of time or over a longer distance than if the heating duct were not provided with branches, bends and/or curves.

"Close contact" means that heat transfer is possible between the first heat medium and a portion of the housing around the inlet.

This will contribute to proper heating of the housing around the inlet, which makes it possible to avoid an excessive temperature drop there.

In a preferred embodiment of the element according to the invention, the heating duct is designed in such a way that the first heat medium can flow from an inlet portion of the housing, which inlet portion is located according to an axial direction of a shaft of the rotor on a side of the housing where the inlet is located, to an outlet portion of the housing, which outlet portion is located according to an axial direction of the shaft on a side of the housing where the outlet is located, and/or vice versa.

As a result of this, the entire housing or at least a major part of the housing can be heated by heat exchange with the first heat medium in the heating duct.

In a subsequent preferred embodiment of the element according to the invention, the rotor is rotatably arranged with respect to the housing by means of bearings, and the element is provided with an injection circuit for injecting a second heat medium to the bearings at a higher temperature than the low temperature.

As a result of this, the bearings can now also be heated in order to prevent them from cooling too much and freezing, which could jeopardize correct operation of the bearings because of increased friction in the bearings.

A first duct of the injection circuit having a first feed point for the second heat medium is preferably located in a first portion of the housing that is located according to an axial direction of a shaft of the rotor on a side of the housing where the inlet is located.

Alternatively or in addition to this, a second duct of the injection circuit having a second feed point for the second heat medium is located in a second portion of the housing that is located according to an axial direction of a shaft of the rotor on a side of the housing where the outlet is located.

An advantage is that, by supplying the second heat medium on an inlet side and/or an outlet side in the element, a feed point can be placed at one and/or two ends of the rotor.

In other words, the bearings on the inlet side of the element and/or the bearings on the outlet side of the element have their own injection point such that the second heat medium is injected as close to the bearings as possible and it is not necessary to transport the second heat medium through the housing from the inlet side of the element to the outlet side of the element or vice versa.

In this way, it is possible to prevent the second heat medium from freezing or cooling too much when passing through the housing, which could cause blockage of the second heat medium in the element and/or possibly deteriorate lubricating properties of the second heat medium.

Because the second heat medium only has to cover a limited distance through the housing from a feed point to the relevant bearings, the second heat medium will cool only minimally, as a result of which the second heat medium can dissipate a maximum of heat to the bearings.

The first feed point and the second feed point can be interconnected by means of a connection duct for the second heat medium in the housing.

The connection duct allows heat exchange between the second heat medium injected via the first and second feed points.

This heat exchange occurs via the second heat medium in the connection duct from the outlet side at a higher temperature to the cold inlet side of the element.

This will ensure a uniform temperature throughout the entire second heat medium, the entire housing and the bearings.

As a result of this, there is also a lower risk that the second heat medium will cool too much locally in the element.

At least one portion of the heating duct is preferably positioned in such a way that heat is exchanged between the heating duct and the first duct, the second duct and/or the connection duct, respectively.

As a result of this, there is a lower risk that the second heat medium will cool too much in the injection circuit.

In a preferred embodiment of the element according to the invention, the element is provided with a heating means for an end of a shaft of the rotor located closest to the inlet.

An advantage is that it is possible to heat this aforementioned end of the shaft in this way.

At this location, a greatest temperature difference with the heating means will be present, such that a maximum possible heat transfer between the heating means and the rotor is possible.

Because of a thermal conductivity of the shaft, heat transferred to the shaft will be distributed throughout the entire shaft and a rotor body of the rotor.

As a result of this, a temperature gradient across the rotor from an inlet side to an outlet side of the element, which would occur in elements already known, can be eliminated and the entire rotor will be at nearly the same temperature.

As a result of this, thermal deformation of the rotor can be limited so that tolerances and clearances between the rotor and the housing remain within reasonable limits and thermal stresses are limited.

The invention also relates to a device for compressing a gas to be compressed having a low temperature of −40° C. or lower, with the characteristic that the device is provided with at least one element according to the invention.

It goes without saying that such a device has the same advantages as the above-described embodiments of the element according to the invention.

The invention also relates to a method for compressing a gas to be compressed having a low temperature of −40° C. or lower by means of an element, which element is provided with a housing containing at least one rotor that is rotatably arranged with respect to the housing and having an inlet for the gas to be compressed and an outlet for compressed gas, with the characteristic that the element is provided with a heating duct that runs through the housing, a first heat medium being introduced into the housing at an inlet of the heating duct and the first heat medium being evacuated from the housing at an outlet of the heating duct.

A temperature of the gas to be compressed having a low temperature is preferably maximally −60° C., and more preferably maximally −100° C.

The first heat medium is preferably a mixture of water and glycol having at least 40% glycol. In this way, the first heat medium has a freezing temperature lower than −40° C.

A temperature of the first heat medium at the inlet of the heating duct is preferably at least 60° C.

The greater a temperature difference between the first heat medium and the gas to be compressed, the greater a driving force behind a heat exchange between said first heat medium and gas to be compressed.

In a preferred embodiment of the method according to the invention, the rotor is rotatably arranged with respect to the housing by means of bearings and a second heat medium is injected to the bearings.

It goes without saying that the advantages of such a method overlap with the advantages of the corresponding embodiments of the element according to the invention described above.

Preferably, the second heat medium is a lubricating fluid, preferably oil.

In this way, the second heat medium is not only useful for heating the bearings, but also for lubricating them.

Finally, the invention also relates to a use of the element or the device according to the invention for compressing a gas to be compressed having a low temperature of −40° C. or lower.

BRIEF DESCRIPTION OF DRAWINGS

In order to better illustrate the features of the invention, some preferred embodiments of an element for compressing a gas to be compressed having a low temperature according to the invention and a device provided with such an element are described below as examples without any limiting character with reference to the attached drawings, in which:

FIG. 2 shows a cross-section according to line II-II in FIG. 1;

DETAILED DESCRIPTION

Figure 1:
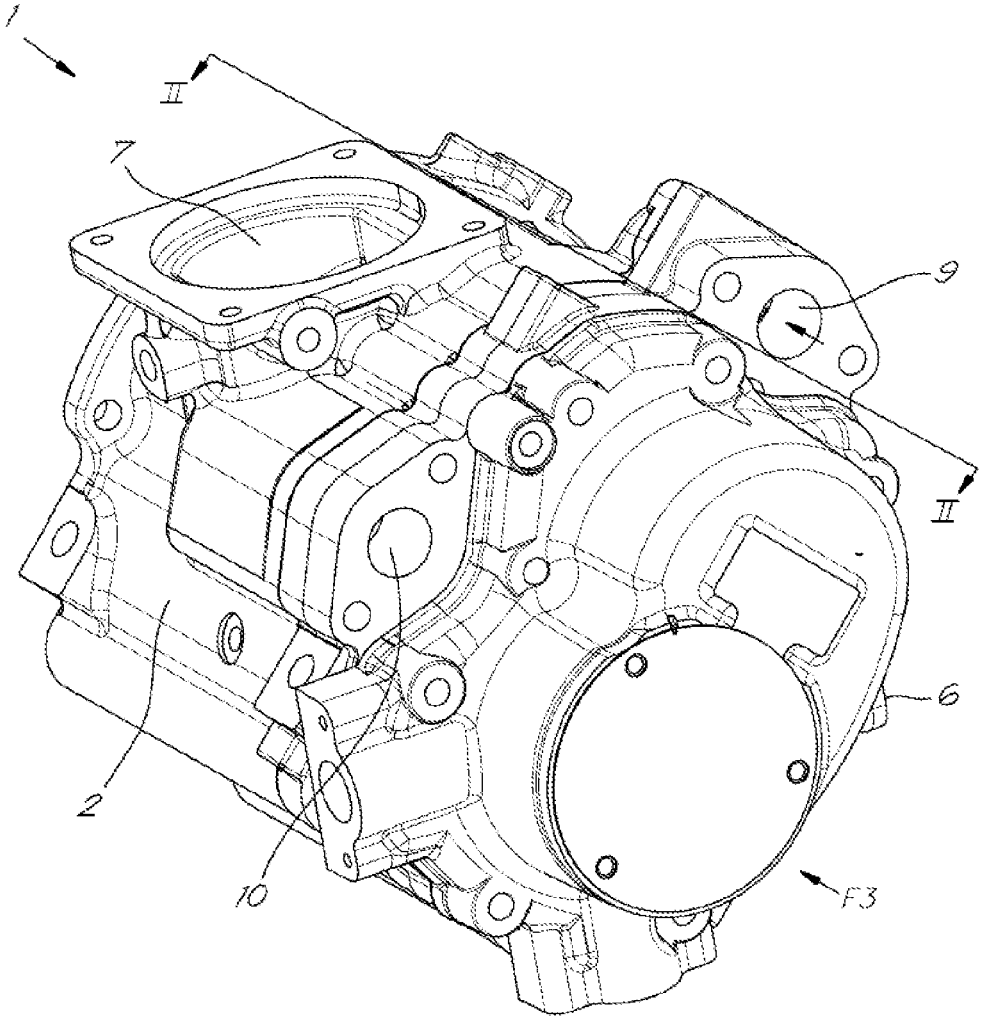
FIG. 1 shows an element according to the invention for use in a device according to the invention schematically and in a perspective view.
Figure 9:
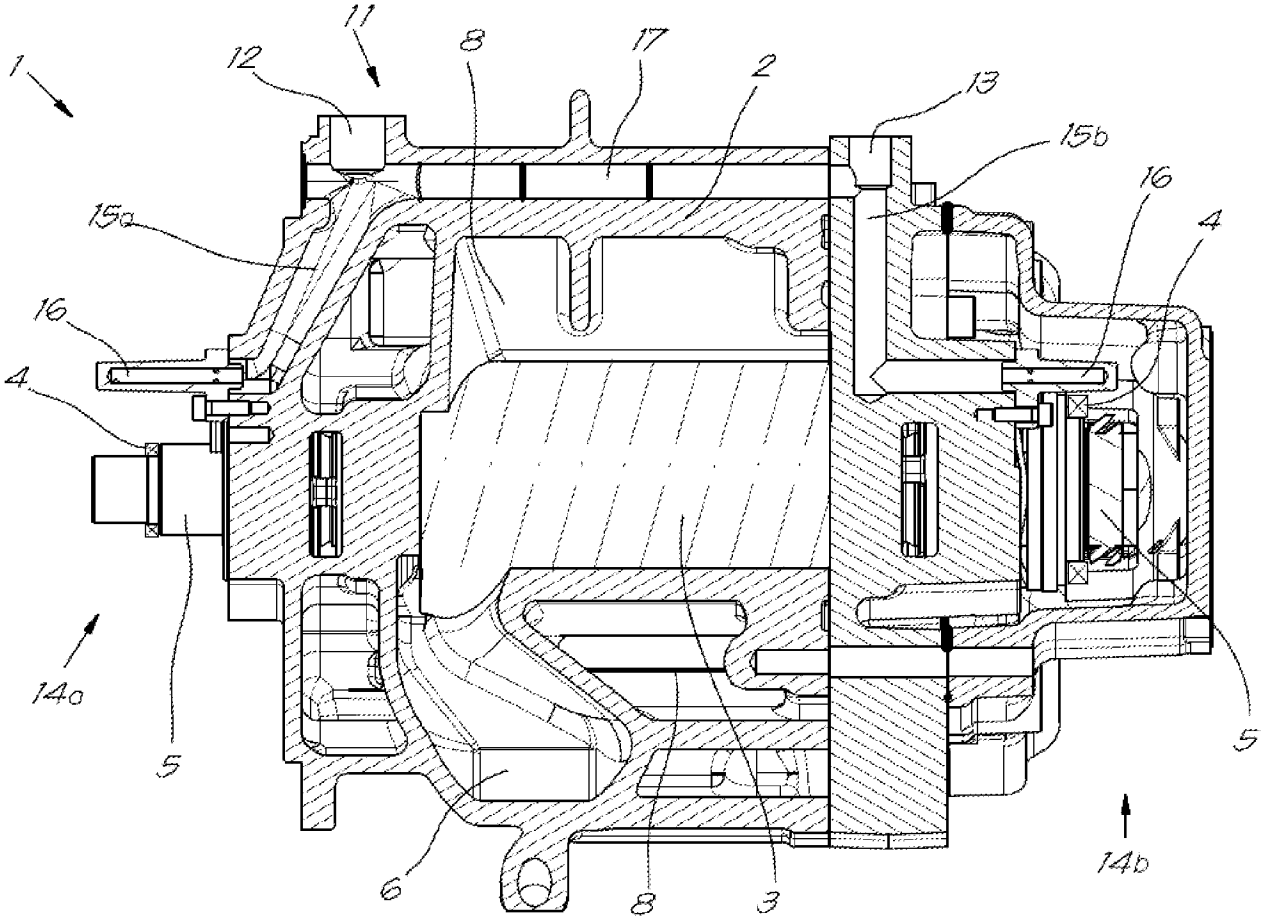

The element 1 according to the invention that is shown in the drawings for use in a device according to the invention is in this case a screw compressor element.

The element 1 comprises a housing 2 containing at least one rotor 3, in this case two helical rotors.

The screw compressor element is, in this case, an oil-free screw compressor element, meaning that in a compression chamber in the housing 2 of the element 1, no oil is injected for lubrication and/or sealing the helical rotors.

The helical rotors are arranged with their shaft 5 rotatable with respect to the housing 2 by means of bearings 4.

The housing 2 also comprises an inlet 6 for gas to be compressed at a low temperature and an outlet 7 for the compressed gas.

According to the invention, the temperature of the gas to be compressed having a low temperature is −40° C. or lower and preferably, but not necessary for the invention, −60° C. or lower, and more preferably −100° C. or lower.

It goes without saying that, as a result of the compression, the compressed gas will have a higher temperature than the gas to be compressed before the compression. Depending on the process, this temperature may be higher than −100° C., −60° C. or −40° C.

According to the invention, the housing 2 is provided with a heating duct 8 that runs through the housing 2. The heating duct 8 is shown in FIG. 2.

The heating duct 8 has an inlet 9 for introducing a first heat medium into the housing 2 and an outlet 10 for evacuating this first heat medium from the housing 2.

Figure 3:
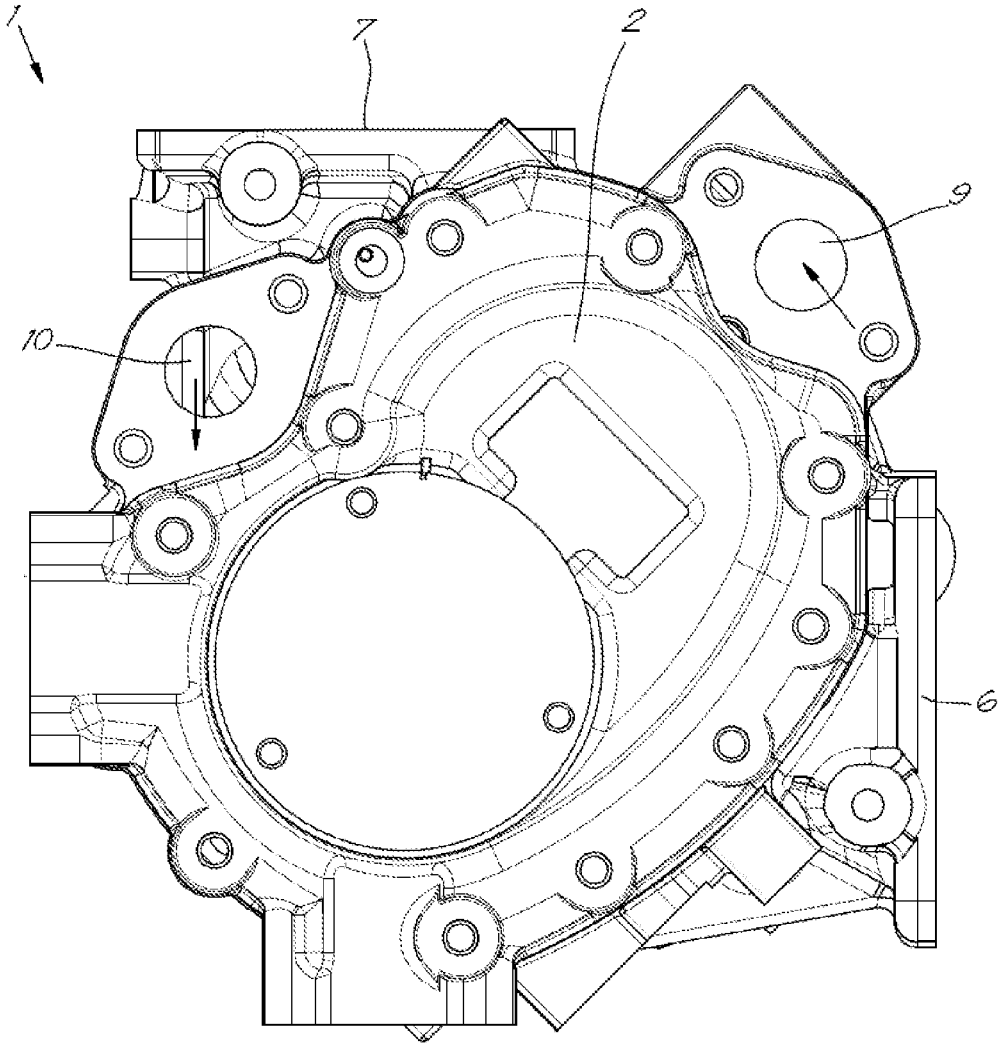
FIG. 3 shows a cross-section according to arrow F3 in FIG. 1.

The inlet 9 and the outlet 10 of the heating duct 8 are shown in FIGS. 1 and 3.

The first heat medium is in this case, but not necessary according to the invention, a mixture of water and glycol, also called 1,2-ethanediol or ethylene glycol.

The first heat medium preferably contains at least 40% glycol. That way, the first heat medium has a freezing temperature lower than −40° C.

The first heat medium itself will have a temperature of, for example, 60° C.

As shown in FIG. 3, the inlet 9 of the heating duct 8 is located near the inlet 6 of the housing 2, and the outlet 10 of the heating duct 8 is located near the outlet 7 of the housing 2.

The inlet 6 of the housing 2 will be the coldest location as the gas to be compressed enters here at a low temperature. At the inlet 9 of the heating duct 8, the first heat medium will have the highest temperature because there has not yet been any heat exchange with the housing 2. When passing through the heating duct 8, the temperature of the first heat medium will decrease until it reaches the outlet 10 near outlet 7, which is typically the location of the housing 2 having the highest temperature.

In this case, but not necessary according to the invention, the heating duct 8 is designed in such a way by means of bends and branches or bifurcations that the first heat medium can flow through the entire housing 2.

This way it can be ensured that the entire housing 2 is heated up to ensure that the temperature of the housing 2 is as uniform as possible.

In addition, the heating duct 8 is provided with branches located near the inlet 6 of the housing 2.

"Near the inlet 6" means that heat exchange may occur between the heat medium and the inlet 6 of the housing 2.

This will ensure that the housing 2 near the inlet 6 will be heated more than in other portions of the housing 2, as here the first heat medium will circulate more, so more heat exchange will occur with the housing 2 near the inlet 6.

It is also possible for the heating duct 8 to have a number of bends or curves near the inlet 6 of the housing 2 instead of or in addition to branches or bifurcations. This will allow to achieve the same effect as described here above for the branches near the inlet 6 of the housing 2.

In the example shown, the element 1 is provided with an injection circuit 11.

It should be noted that this injection circuit 11 is used to allow the injection of a second heat medium to the bearings 4. In other words, the injection circuit 11 is not used to inject oil into the compression chamber.

As shown in FIG. 2, the injection circuit 11 is provided with two feed points 12, 13 for the second heat medium into the element 1 at two different locations in the housing 2.

As shown, there is a feed point 12, 13 in the housing 2 at each end 14*a*, 14*b* of the rotor 3.

As a result of this, the second heat medium can be injected into the housing 2 as close as possible to the bearings 4 at the ends 14*a*, 14*b* of the shaft 5 of the rotor 3.

Ducts 15*a*, 15*b* will run through the housing 2 from the feed points 12, 13 to the bearings 4 for supplying the second heat medium to the bearings 4.

Suitable nozzles 16 are provided at the bearings 4.

As shown in FIG. 2, the two feed points 12, 13 are interconnected by means of a connection duct 17 for the second heat medium in the housing 2.

Said connection duct 17 will be filled with the second heat medium while the device is being operated.

In this case, a portion of the heating duct 8 will be located near the connection duct 17 and/or the aforementioned ducts 15*a*, 15*b* such that heat exchange is possible between the heat media in these ducts 8, 15*a*, 15*b*, 17.

In other words, the first heat medium will be able to heat the second heat medium.

The screw compressor element operates in a very simple manner and as follows.

During the operation of the screw compressor element, the helical rotors will cooperatively rotate in an intermeshing way and draw in the gas to be compressed having a low temperature via the inlet 6 in the housing 2.

The gas is compressed by the helical rotors 3 and will exit the screw compressor element 1 through the outlet 7 in the housing 2.

In this case, the gas to be compressed at a low temperature will strongly cool the housing 2.

Although the temperature of the gas will increase during the compression process, the temperature of the gas will still be so low that after compression the compressed gas will still cool the housing 2.

During the operation of the element 1, the first heat medium will flow through the heating duct 8, where it will heat the housing 2.

A temperature of the first heat medium at the inlet 9 of the heating duct 8 is, for example, 60° C., but it should be clear that this temperature of the first heat medium will be chosen depending on a temperature of the gas to be compressed at a low temperature.

The heating will be greater near the inlet 9, where the first heat medium will have the highest temperature, than near the outlet 10, where the first heat medium will have a lower temperature.

Because the inlet 6 is the coldest location of the housing 2, most of the heating will be necessary here.

By means of the branches near the inlet 6 of the housing 2, the first heat medium will undergo heat exchange with the portion of the housing 2 near the inlet 6 for a longer period of time than if said branches were not present such that sufficient heating of said portion of the housing 2 is possible.

Then, the first heat medium will flow through the entire housing 2 along the heating duct 8 to heat the housing 2.

It should be noted that by heating the housing 2, the rotor 3 is also heated by the first heat medium, though indirectly.

As a result of this, the temperature of the entire element 1 will be kept as high as possible, said temperature also being uniform.

As a result of the heating of the housing 2, the bearings 4 will also indirectly be partially heated.

However, to ensure proper functioning of the bearings 4, the injection circuit 11 will inject the second heat medium onto the bearings 4 at a temperature higher than the low temperature of the gas to be compressed.

For the bearings 4 on each end 14*a*, 14*b* of the shaft 5 of the rotor 3, a special feed point 12, 13 is provided in housing 2, allowing the second heat medium to be brought to the bearings 4 using the shortest possible duct 15*a*, 15*b*.

In this way, a decrease in the temperature of the second heat medium when passing through the cold housing 2 can be limited as much as possible before the second heat medium reaches the bearings 4.

Furthermore, because a portion of the heating duct 8 is located near the ducts 15*a*, 15*b*, this will help ensure that the temperature of the second heat medium on its way to the bearings 4 drops as little as possible so that the bearings 4 can be heated to the maximum extent possible.

The purpose of the connection duct 17, which provides a connection between the two feed points 12, 13, is to allow heat exchange with the second heat medium, which is injected via two feed points 12, 13.

Said connection duct 17 will be filled with the second heat medium and, although said second heat medium is normally stationary and will not reach the bearings 4, heat exchange will nevertheless be possible via the second heat medium in the connection duct 17 from the outlet 7 at a higher temperature to the very cold inlet 6.

This will ensure a uniform temperature throughout the entire second heat medium in the housing 2, the entire housing 2 and the bearings 4.

In this case, there is also no risk of the second heat medium cooling too much.

Furthermore, because a portion of the heating duct 8 is located near the connection duct 17, this will help ensure that the temperature of the second heat medium drops as little as possible in the connection duct 17. In this way, it is possible to prevent the second heat medium from freezing and thereby the connection duct 17 from becoming dogged.

The present invention is by no means limited to the embodiments described as examples or shown in the drawings, but an element for compressing a gas to be compressed having a low temperature according to the invention and a device provided with such an element can be realized in all kinds of shapes and dimensions without departing from the scope of the invention as defined in the claims.

The invention claimed is:

1. An element for compressing a gas to be compressed at a low temperature of −40° C. or lower, the element comprising:

a housing comprising:

at least one rotor that is rotatably arranged with respect to the housing;

an inlet for the gas to be compressed; and an outlet for compressed gas; and a heating duct that extends through the housing, the heating duct comprising:

an inlet where a first heat medium is introduced into the housing at a higher temperature than the low temperature; and an outlet where the first heat medium is evacuated from the housing, wherein the heating duct is configured such that the first heat medium flows, within the heating duct, from an inlet portion of the housing to an outlet portion of the housing, and the inlet portion is located according to an axial direction of a shaft of the at least one rotor on a first side of the housing where the inlet of the housing is located, and the outlet portion is located according to the axial direction of the shaft on a second side of the housing where the outlet of the housing is located.

2. The element according to claim 1, wherein the low temperature of the gas to be compressed is equal to or less than −60° C.

3. The element according to claim 1, wherein the first heat medium is a mixture of water and glycol having at least 40% glycol.

4. The element according to claim 1, wherein the inlet of the heating duct is positioned in such a way that heat is exchanged between the inlet of the housing and the inlet of the heating duct.

5. The element according to claim 1, wherein the outlet of the heating duct is positioned in such a way that heat is exchanged between the outlet of the housing and the outlet of the heating duct.

6. The element according to claim 1, wherein the heating duct is provided with branches that are positioned in such a way that heat is exchanged between the branches and the inlet of the housing.

7. The element according to claim 1, wherein the heating duct has a number of bends and/or curves that are positioned in such a way that heat is exchanged between the bends and/or curves and the inlet of the housing.

8. The element according to claim 1, wherein the at least one rotor is rotatably arranged with respect to the housing (2) by bearings (4), and the element further comprises an injection circuit that is configured to inject a second heat medium to the bearings at a higher temperature than the low temperature.

9. The element according to claim 8, wherein the injection circuit comprises:

a first duct comprising a first feed point for receiving the second heat medium, the first duct located in a first portion of the housing that is on the first side of the housing.

10. The element according to claim 9, wherein the injection circuit further comprises:

a second duct comprising a second feed point for receiving the second heat medium, the second duct located in a second portion of the housing that is on the second side of the housing.

11. The element according to claim 10, wherein the injection circuit further comprises a connection duct for the second heat medium in the housing, the connection duct interconnecting the first feed point and the second feed point.

12. The element according to claim 11, wherein at least one portion of the heating duct is positioned in such a way that heat is exchanged between the heating duct and the first duct, the second duct, and/or the connection duct.

13. The element according to claim 1, wherein the element is a screw compressor element, and the at least one rotor is at least one helical rotor.

14. The element according to claim 13, wherein the element is an oil-free screw compressor element.

15. A method performed by an element, the method comprising:

receiving a gas at an inlet of a housing of the element, the gas having a low temperature of −40° C. or lower, and the housing including at least one rotor that is rotatably arranged with respect to the housing;

compressing the gas in the housing;

evacuating the gas at an outlet of the housing;

receiving a first heat medium at an inlet of a heating duct of the housing, the heating duct extending through the housing, and the first heat medium being received at a temperature higher than the low temperature; and evacuating the first heat medium at an outlet of the heating duct, wherein the heating duct is configured such that the first heat medium flows, within the heating duct, from an inlet portion of the housing to an outlet portion of the housing, and the inlet portion is located according to an axial direction of a shaft of the at least one rotor on a first side of the housing where the inlet of the housing is located, and the outlet portion is located according to the axial direction of the shaft on a second side of the housing where the outlet of the housing is located.

16. The method according to claim 15, wherein the low temperature of the gas is equal to or less than −60° C.

17. The method according to claim 15, wherein the first heat medium is a mixture of water and glycol having at least 40% glycol.

18. The method according claim 15, wherein the temperature of the first heat medium is at least 60° C. at the inlet of the heating duct.

19. The method according to claim 15, wherein the at least one rotor is rotatably arranged with respect to the housing by bearings, and the method further comprises injecting a second heat medium to the bearings.

20. The method according to claim 19, wherein the second heat medium is a lubricating fluid.

* * * * *